US008875427B2

(12) United States Patent
Valiulis

(10) Patent No.: US 8,875,427 B2
(45) Date of Patent: Nov. 4, 2014

(54) RAIL INCLUDING MAGNETIC STRIP

(75) Inventor: Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 13/435,800

(22) Filed: Mar. 30, 2012

(65) Prior Publication Data

US 2013/0255120 A1 Oct. 3, 2013

(51) Int. Cl.
*G09F 7/04* (2006.01)

(52) U.S. Cl.
CPC ..... *G09F 7/04* (2013.01)
USPC ..... 40/600; 40/661.01

(58) Field of Classification Search
USPC ..... 40/594, 600, 661.08, 606.12, 611.11, 40/661.09, 661.01; 156/160, 66; 248/317, 248/206.5, 57; 24/303, 304
See application file for complete search history.

(56) References Cited

U.S. PATENT DOCUMENTS

| | | | | |
|---|---|---|---|---|
| 2,384,208 | A | 9/1945 | Stroud | |
| 3,395,555 | A | 8/1968 | Hickman | |
| 3,606,507 | A * | 9/1971 | Williams | 312/184 |
| 3,657,907 | A | 4/1972 | Boving | |
| 3,831,986 | A | 8/1974 | Kobayashi | |
| 3,837,195 | A | 9/1974 | Pelto | |
| 3,837,525 | A | 9/1974 | Kobayashi | |
| 3,855,827 | A | 12/1974 | Hallman et al. | |
| 3,911,534 | A | 10/1975 | Martens et al. | |
| 3,967,480 | A | 7/1976 | Stackhouse | |
| 4,425,771 | A | 1/1984 | Beach et al. | |
| 4,466,540 | A | 8/1984 | Lotrous et al. | |
| 4,651,136 | A | 3/1987 | Anderson et al. | |
| 4,670,950 | A | 6/1987 | Wisecup et al. | |
| 4,966,020 | A | 10/1990 | Fotheringham et al. | |
| 4,987,754 | A | 1/1991 | Minasy et al. | |
| 5,069,047 | A | 12/1991 | Lynch et al. | |
| 5,077,872 | A | 1/1992 | Guthammar | |
| 5,188,332 | A * | 2/1993 | Callas | 248/544 |
| 5,468,031 | A | 11/1995 | Holmgren | |
| 5,524,752 | A | 6/1996 | Mazzucchelli | |
| 5,722,266 | A | 3/1998 | Yeager et al. | |
| 5,760,689 | A | 6/1998 | Holmgren | |
| 5,782,350 | A | 7/1998 | Weisburn et al. | |
| 5,856,782 | A | 1/1999 | Sasagawa et al. | |
| 5,864,290 | A | 1/1999 | Toyomi et al. | |
| 5,921,518 | A * | 7/1999 | Bernardi | 248/304 |
| 5,979,196 | A | 11/1999 | Vanmoor | |
| 6,082,156 | A | 7/2000 | Bin | |
| 6,336,554 | B1 | 1/2002 | Brühwiler | |
| 6,374,648 | B1 | 4/2002 | Mitsuyama | |
| 2002/0003095 | A1 | 1/2002 | Jaeb et al. | |

(Continued)

FOREIGN PATENT DOCUMENTS

| | | |
|---|---|---|
| DE | 38 32 835 A1 | 3/1990 |
| DE | 195 45 816 A1 | 6/1997 |

(Continued)

*Primary Examiner* — Charles A. Fox
*Assistant Examiner* — Christopher E Veraa
(74) *Attorney, Agent, or Firm* — Reinhart Boerner Van Deuren P.C.

(57) ABSTRACT

A rail for supporting hanging signage is provided. The rail includes a magnetic strip. The magnetic strip includes first and second end portions and a middle portion. When the rail is in an uncoupled configuration, the first and second end portions are offset from a horizontal reference plane including the middle portion.

6 Claims, 4 Drawing Sheets

(56) References Cited

U.S. PATENT DOCUMENTS

| | | | |
|---|---|---|---|
| 2002/0185397 | A1 | 12/2002 | Sedon et al. |
| 2003/0047530 | A1 | 3/2003 | Durbin |
| 2003/0051517 | A1 | 3/2003 | Aarts |
| 2003/0094021 | A1 | 5/2003 | Takinami |
| 2003/0116455 | A1 | 6/2003 | Marsilio et al. |
| 2003/0160697 | A1 | 8/2003 | Sedon et al. |
| 2005/0044904 | A1 | 3/2005 | Horngren et al. |
| 2005/0172682 | A1 | 8/2005 | Holmgren |

FOREIGN PATENT DOCUMENTS

| | | | |
|---|---|---|---|
| EP | 1 091 063 | A2 | 4/2001 |
| WO | WO 96/23123 | A1 | 8/1996 |
| WO | WO 01/20107 | A2 | 3/2001 |
| WO | WO 01/57348 | A1 | 8/2001 |

* cited by examiner

RAIL INCLUDING MAGNETIC STRIP

FIELD OF THE INVENTION

This invention generally relates to signage supporting mechanisms, and more particularly to a retail signage supporting rail with a magnetic strip configured to couple with a metal worksurface.

BACKGROUND OF THE INVENTION

Signage including advertising, pricing, and other information for consumers may be displayed in retail environments. In some situations, the signage should be supported, for example, in a hanging configuration, such as, for example, from the ceiling. In order to present the signage in such a hanging configuration, various mounts may be employed.

One example of such a mount is a merchandise rail having magnetic backing The magnetic backing presents a flat planar surface for magnetic attachment to a structure, such as for example a ceiling grid. The magnetic force presented by the flat planar surface of the magnetic backing tends to pull the entire merchandise rail against the ceiling grid in a swift, single action which causes the entire flat planar surface of the magnetic backing to contact the ceiling grid at the same time in relatively swift and uncontrollable manner. Such attachment can lead to misalignment of the rail relative to the ceiling grid, i.e. the rail is not parallel with the length of ceiling gird it is intended to attach to. Such misalignment presents an issue of aesthetics as well as a safety risk.

Unfortunately, once attached, fine adjustment of the rail to make it parallel with the length of ceiling grid can be very difficult if not impossible. As a result, when the magnetic backing attaches, if it is not aligned perfectly during attachment, the rail must be entirely removed and installed again in an attempt to achieve the proper alignment. To assure secure support of the rail by the metal grid, the rail and the magnetic strip may be properly aligned with the metal grid. When a large portion of the magnetic strip contacts the metal grid it may be difficult to adjust the alignment of the rail relative to the metal grid due to the strong magnetic attraction between the metal grid and portions of the magnetic strip contacting the metal grid.

BRIEF SUMMARY OF THE INVENTION

In one aspect, an embodiment of a mounting rail for retail signage is provided. The rail has an uncoupled configuration and a coupled configuration. The rail is configured in the coupled configuration to couple with a mounting surface. The rail includes a base. The base includes a first side and a second side opposite the first side. The rail also includes a magnetic strip extending from a first end point to a middle point to a second end point coupled with the first side extending along at least a portion of the base portion. The rail also includes a support. The support is coupled to the second side of the base and is configured to support signage. When the rail is in the uncoupled configuration, the middle mount is not collinear with the first and second end points.

In one embodiment, the rail includes a coupling portion extending generally perpendicularly from the support to the base. In one embodiment, the first and second end points are each offset in a vertical direction from the middle point by at least 1/16th of an inch.

In one embodiment, the support includes a pair of opposed legs extending from the coupling portion. The opposed legs define between them a signage receiving channel. The opposed legs are arranged and configured to support signage for hanging from the rail. A portion of this signage is disposed within the signage receiving channel.

In one embodiment, each leg includes a generally vertical portion extending away from the base. The legs include opposed flanges extending inwardly toward one another. The flanges are configured to support hanging signage. The opposed flanges define a gap between them arranged to permit signage to pass therethrough.

In one embodiment, the magnetic strip and the base are coextensive.

In one embodiment, in the coupled configuration, the first end point, the middle point, and the second end point reside in one reference plane. In one embodiment the rail has a longitudinal axis along its entire length, wherein the longitudinal axis is curved in the uncoupled configuration.

In one embodiment, the rail is biased toward the bowed state in the uncoupled configuration. The magnetic strip is configured such that when the middle point is displaced toward the mounting surface, the attractive force between the magnetic strip and the mounting surface overcomes the bias of the rail.

In another aspect, an embodiment of a rail is provided. The rail is configured to surface mount with a metal portion of a ceiling grid. The rail includes a base. The rail also includes a magnetic strip coupled to the base. The rail also includes a support coupled to the base. The rail has a first configuration in which the magnetic strip is bowed for adjustment relative to the metal portion of the ceiling grid such that the first and second end portions of the metal grid will contact the metal portion without a middle portion interposed between the first and second end portions of the magnetic strip contacting the metal portion of the ceiling grid.

In one embodiment, the rail has a second configuration in which the magnetic portion is not bowed and is surface mounted with the metal portion of the ceiling grid.

In one embodiment, when the magnetic strip is not coupled to a surface, the rail is biased toward the first bowed configuration.

In one embodiment, the rail is configured to maintain the first configuration until it is displaced to the second configuration to be surface mounted to the metal portion of the ceiling grid.

In one embodiment, the base and support are unitarily extruded.

In another aspect, a method of displaying signage is provided. The method includes providing a rail including a base having a magnetic strip and a support coupled to the base, the rail having a first configuration in which the base is bowed and a second configuration in which the base is not bowed. The method also includes adjusting the rail in the first configuration relative to a fixture to which the rail is to be coupled such that first and second end portions of the magnetic strip contact the fixture without a middle portion of the magnetic strip interposed between the first and second end portions contacting the fixture. The method also includes placing the adjusted rail in the second configuration coupling the rail to the fixture such that the middle portion contacts the fixture.

In one embodiment, the rail includes a support defining a channel configured to support signage. The method includes placing signage within the channel defined by the support.

In one embodiment, the fixture is a metal portion of a ceiling grid.

In one embodiment, the rail includes a first end portion, a middle portion, and a second end portion. The middle portion is offset from the first end portion and the second end portion relative to a horizontal reference plane when the rail is in the first configuration.

In one embodiment, the middle portion is offset from the first end portion and the second end portion in a direction perpendicular to the horizontal reference plane, when the rail is in the first configuration, by at least 1/16th of an inch. The rail is configured to maintain the first configuration until the rail is coupled to a fixture.

In one embodiment, the rail includes a first end portion, a middle portion and a second end portion. The first end portion, the middle portion, and the second end portion are in a single reference plane when the rail is in the second configuration.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of embodiments of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, embodiments of the present invention provide a rail with a magnetic strip, shown in the illustrated embodiment as a signage supporting rail that, when used in various arrangements may provide for easy and secure attachment to a metal fixture, such as, in the illustrated embodiments, a metal portion of a ceiling grid which supports ceiling tiles. Those skilled in the art will recognize that such a mounting configuration is one of many in which the aspects of the invention may be employed advantageously, and as such, should be taken by way of example and not limitation.

Figure 1:
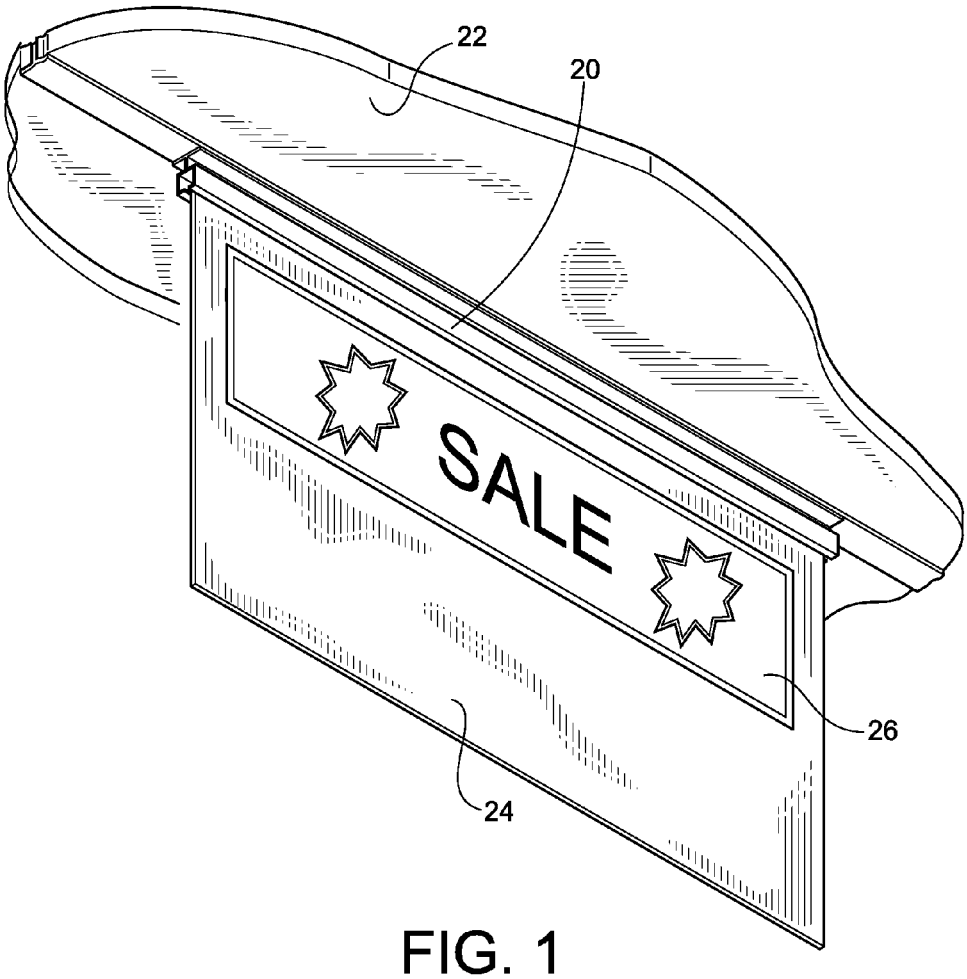
FIG. 1 is a perspective view of a first embodiment of a rail hanging from a ceiling supporting hanging signage.

FIG. 1 depicts one embodiment of a rail 20, such as a mounting rail, according to the teachings of the present invention. The rail 20 is illustrated hangingly supported from a ceiling 22. The rail 20 supports signage 24 hanging from the rail 20. The signage 24 is illustrated including exemplary indicia 26. The signage 24 may include indicia regarding pricing, sales, product information, or other information for customers. As will be explained more fully below, the rail 20 has a mounted and an unmounted configuration. In the unmounted configuration, rail 20 has a generally curved or bowed longitudinal shape. This curved or bowed shape allows for expeditious alignment and installation of the rail 20, to avoid the issues of misalignment described above.

Figure 2:
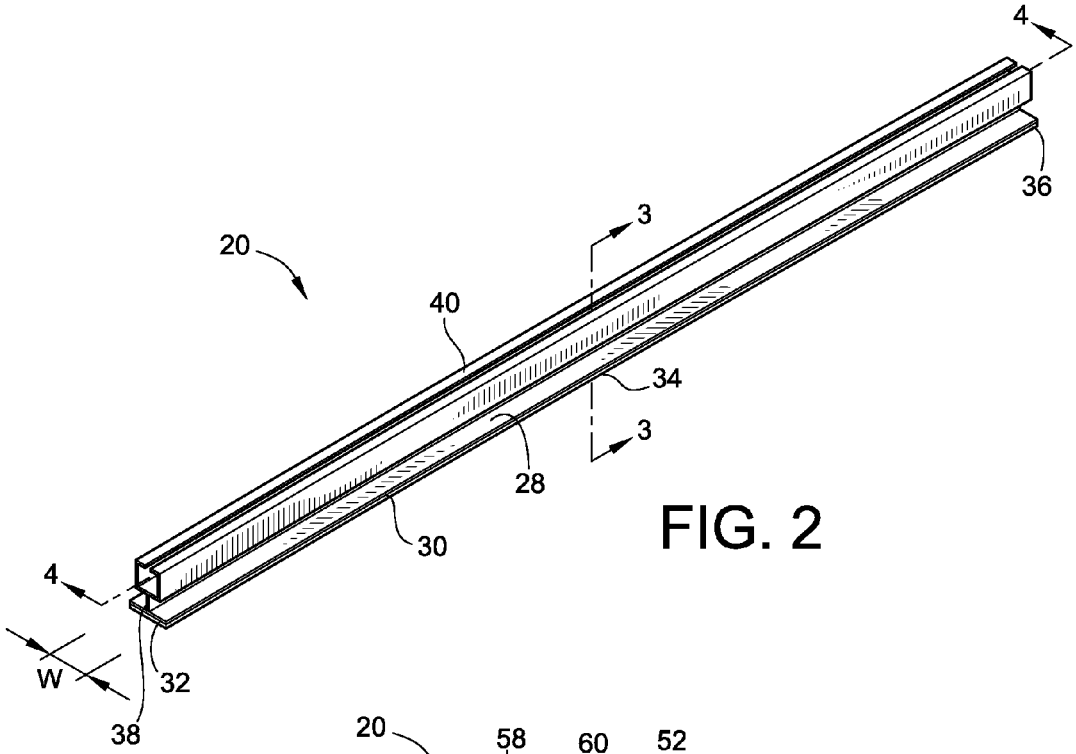
FIG. 2 is a perspective view of the rail of FIG. 1.

With reference to FIG. 2, the rail 20 is illustrated. The rail 20 includes a base 28. Coupled to a first side of the base 28 is a magnetic strip 30. In the illustrated embodiment, the base 28 and the magnetic strip 30 are coextensive. In other embodiments, the base 28 and magnetic strip 30 may be non-coextensive.

Figure 3:
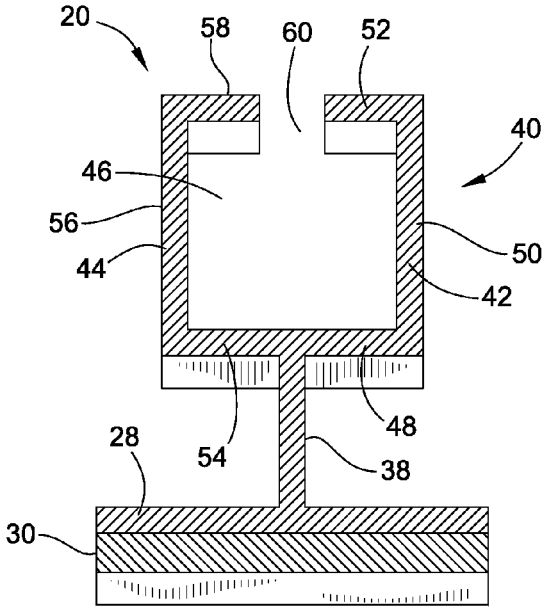
FIG. 3 is a cross-sectional view of the rail of FIG. 2 taken along the line 3-3 in FIG. 2.

The base 28 and the magnetic strip 30 extend from a first end portion 32 to a middle portion 34 to a second end portion 36. As used herein, the term "portion" can include a single point. In one embodiment, the base 28 and the magnetic strip 30 also extend a width W. In another embodiment, the base 28 and the magnetic strip 30 extend different widths from one another. Extending away from a second side of the base 28 opposite the first side of the base is a coupling portion 38. The coupling portion 38 extends generally perpendicularly to the base 28 away from the second side of the base 28 from approximately the midpoint of the base 28 relative to the width W. The coupling portion 38 extends from the first end portion 32 to the middle portion 34 to the second end portion 36. With reference to FIG. 3, when viewed in cross-section, the base 28 and the coupling portion 38 generally form a "T" shape.

With reference to FIG. 3, coupled to the coupling portion 38 distal from the base 28 is a support 40. The support 40 is configured to receive and support signage. The support 40 includes first and second opposed legs 42 and 44. The legs 42 and 44 define between them a channel 46 into which a portion of signage to be supported is received. Those skilled in the art will recognize, however, that the signage may wrap around an exterior of the legs 42, 44 as an alternative.

The first leg 42 includes a first portion 48 extending generally perpendicularly away from the coupling portion 38 and generally parallel with the base 28. Extending from an end of the first portion 48 distal from the coupling portion 38 is a second portion 50. The second portion 50 extends generally perpendicularly from the first portion 48, generally away from the base 28 generally perpendicularly to the base 28, and generally parallel with the coupling portion 38. Extending from an end of second portion 50 distal from the first portion 48 is a third portion 52, such as a flange. The third portion 52 extends generally perpendicularly from the second portion 50 towards the second leg 44, generally parallel with the first portion 48.

With further reference to FIG. 3, the second leg 44 includes a first portion 54 extending generally perpendicularly away from the coupling portion 38 in an opposite direction from the first portion 48 of the first leg 42 and generally parallel with the first portion 48 of the first leg 42. Extending from an end of the first portion 54 distal from the coupling portion 38 is a second portion 56. The second portion 56 extends generally perpendicularly from the first portion 54, generally parallel with the second portion 50 of the first leg 42. Extending from an end of the second portion 56 distal from the first portion 54 is a third portion 58, such as a flange. The third portion 58 extends generally perpendicularly from the second portion 56 towards the first leg 42 and extends generally parallel with the third portion 52 of the first leg 42. The third portions 52 and 58 do not extend completely to one another, defining between them a gap 60. Thus, a portion of a sign may be received and retained in the channel 46 while the sign may pass through the gap 60 and hang downwardly from the support 40.

Figure 4:
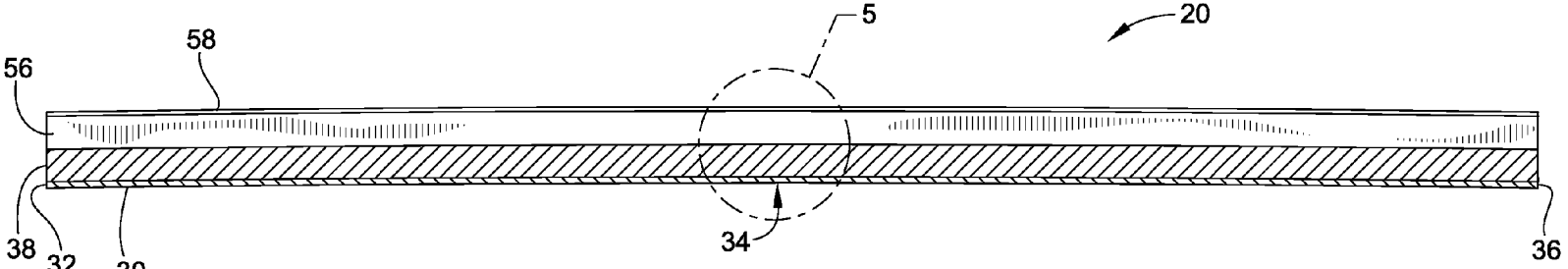
FIG. 4 is a cross-sectional view of the rail of FIG. 2 taken along the line 4-4 in FIG. 2.
Figure 5:
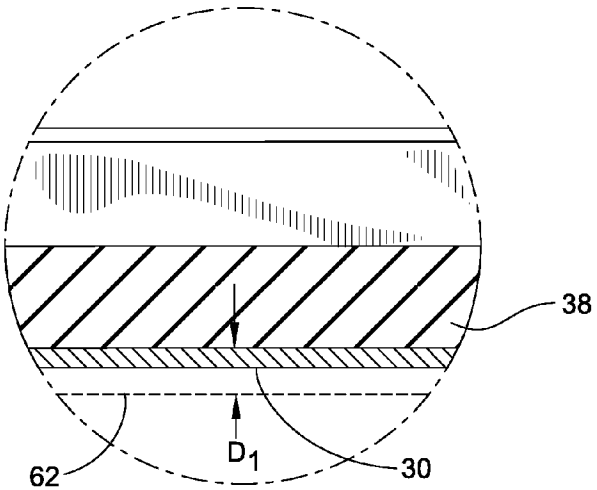
FIG. 5 is a detail view of the portion indicated at 5 in FIG. 4.

With reference to FIG. 4, a cross-sectional view of the rail 20 is illustrated in an uncoupled configuration. The first end portion 32 and the second end portion 34 lie in a horizontal reference plane 62, illustrated in FIG. 5. In the uncoupled configuration, the rail 20 is bowed. The middle portion 34 does not lie in the horizontal reference plane 62. The middle portion 34 is instead vertically (in a direction perpendicular to the horizontal reference plane 62) offset from the horizontal reference plane 62, and thus from the end portions 32 and 34. With reference to FIG. 5, the middle portion 34 is vertically offset from the end portions 32 and 36 by a distance $D_1$. In one embodiment, $D_1$ is at least, approximately 1/32 inches. In another embodiment, D1 is at least, approximately 1/16 inches. In another embodiment, D1 is more than approximately 1/16 inches.

Figure 6:
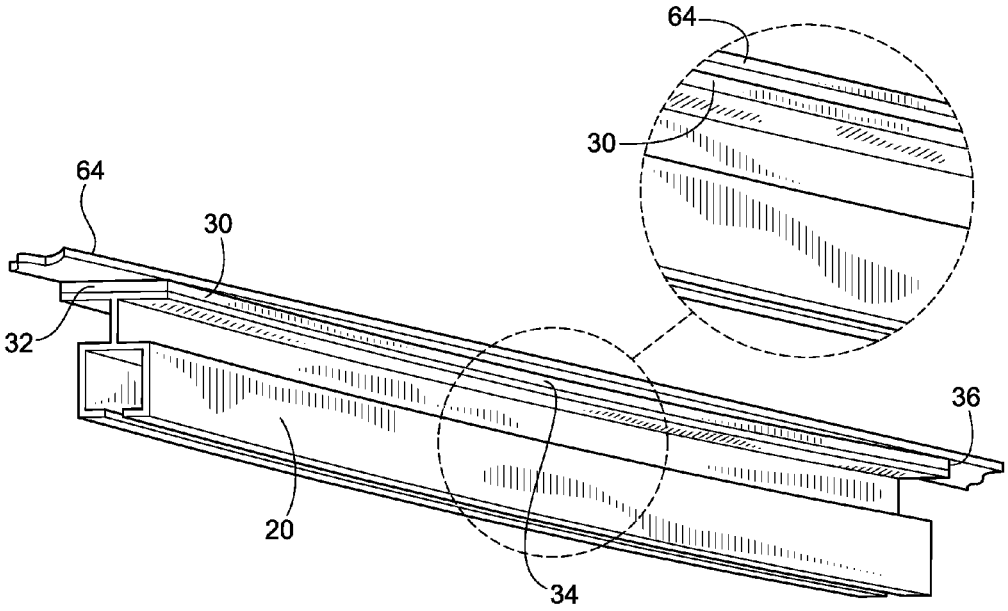
FIG. 6 is a side perspective view of the rail of FIG. 2 in an uncoupled configuration with the end portions of the rail in contact with a metal ceiling grid.
Figure 6A:
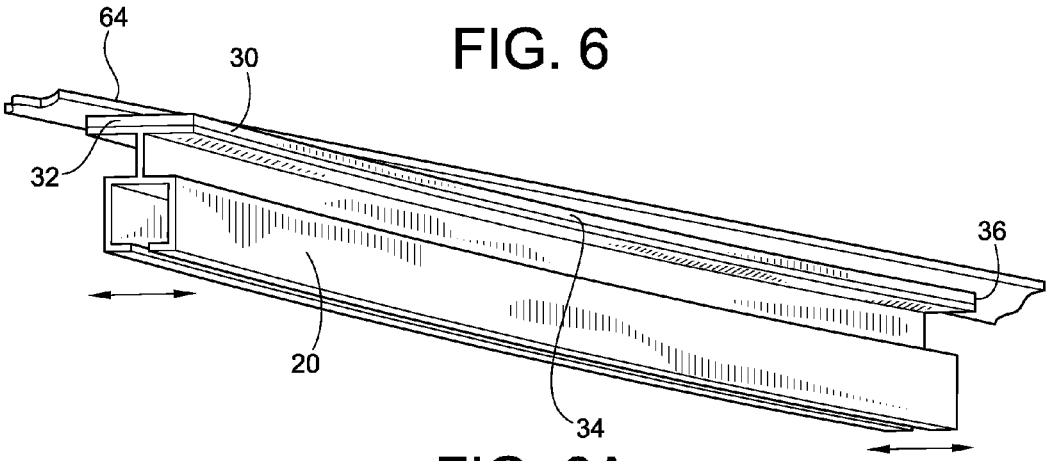
FIG. 6A is a side perspective view of the rail of FIG. 2 in an uncoupled configuration being adjusted relative to the metal ceiling grid.

With reference to FIG. 6, when the rail 20 is in the uncoupled configuration, the rail 20 can be arranged with the first end portion 32 and second end portion 36 in contact with a metal portion 64 of a ceiling grid, and the middle portion 34 separated from the ceiling grid. With reference to FIG. 6A, with only the end portions 32 and 34 in contact with the metal portion 64 of the ceiling grid, the rail 20 can be easily adjusted relative to the metal portion 64 to align the rail 20 with the metal portion 64. In the configuration in FIGS. 6 and 6A, the end points of the magnetic strip 30 are not collinear with the midpoint of the magnetic strip 30.

Figure 7:
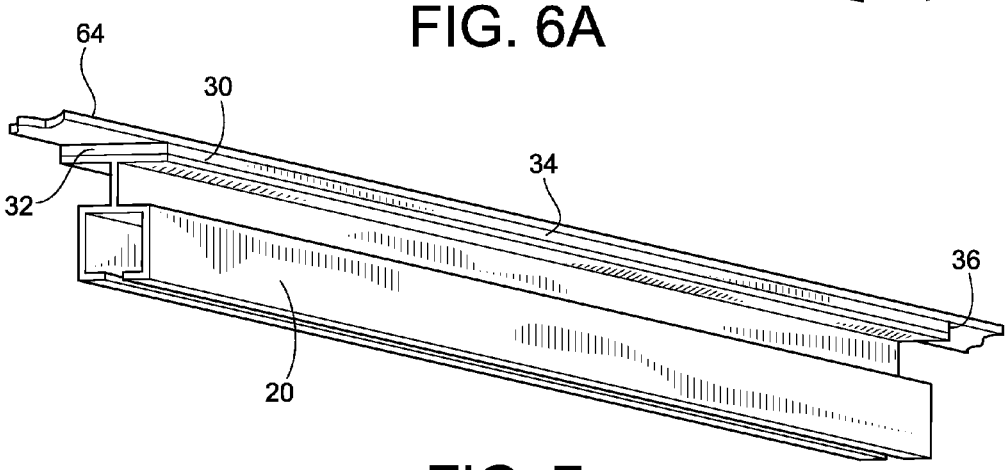
FIG. 7 is a side perspective view of the rail of FIG. 2 in a coupled configuration coupled with a metal ceiling grid.

With reference to FIG. 7, once the rail 20 is aligned with the metal portion 64, the rail 20 can be placed in the coupled configuration, in which the rail 20 is no longer bowed and in which the first end portion 32, the middle portion 34, and the second end portion 36 are all disposed within the same plane and all are in contact with the metal portion 64 of the ceiling grid.

In one embodiment, the base 28, the coupling portion 38, and the support 40 are unitarily formed from a material such that the rail 20 has flexible characteristics. In one embodiment, the base 28, the coupling portion 38, and the support 40 are unitarily extruded from plastic material, such as, for example, polyvinyl chloride, co-extruded polyvinyl chloride, butryrate, provista, acrylonitrile butadiene styrene or any other suitable material. In another embodiment the base 28, the coupling portion 38, and the support 40 are separately formed and coupled together by any suitable mechanism.

In one embodiment, the magnetic strip 30 is unitarily formed with the base 28 by any suitable mechanism. In another embodiment, the magnetic strip 30 may be a strip formed separately from the base 28 and coupled with the base 28 by adhesive, heat staking, fasteners, or any other suitable mechanism. In one embodiment, the magnetic strip 30 has flexibility characteristics allowing it to be disposed in a bowed state matching the bowed state of the base 28 in the uncoupled configuration of the rail 20 and in an unbowed state matching the unbowed state of the base 28 when the rail 20 is in the coupled configuration.

Thus, the rail 20 can transition to from the uncoupled configuration to the coupled configuration and return to the uncoupled configuration. Additionally, in one embodiment, the rail 20 is configured such that it is biased or has memory, i.e., it tends to return to its bowed state when it is returned from its coupled configuration to its uncoupled configuration (i.e., removed from a metal portion of a ceiling grid). Thus, the rail 20, including the magnetic strip 30, is biased towards a bowed configuration. When the rail 20, including the magnetic strip 30, is not coupled to a worksurface, e.g., a metal portion of a ceiling grid, the rail 20, including the magnetic strip 30, tends to maintain the bowed configuration. Additionally, in one embodiment, the rail 20 is constructed in such a manner that it will maintain its bowed configuration until displaced by a user to the unbowed configuration to couple the rail 20 to a metal portion of a ceiling grid. Once placed in the unbowed configuration, the rail 20 is configured such that the attractive force between the magnetic strip 30 and a metal portion of a ceiling grid is sufficient to maintain the rail 20 in the unbowed coupled configuration. However, once a user exerts sufficient force to detach the rail 20 from the ceiling grid and to overcome the attraction between the magnetic strip 30 and the metal portion of the ceiling grid, the rail 20 is constructed in such a manner that it will return to its bowed configuration and maintain the bowed configuration until once again attached to a ceiling grid.

However, when the rail 20 is to be coupled with a worksurface, e.g., a metal portion of a ceiling grid, the end portions 32 and 36 are located near the metal portion of the ceiling grid, and the rail 20, still in the bowed configuration, is aligned with the metal portion of the ceiling grid. In this configuration, with only the end portions 32 and 36 configured abutting the metal portion of the ceiling grid, the attractive magnetic force between the magnetic strip 30 and the metal portion of the ceiling grid is less than when the entire magnetic strip 30 is in contact with the metal portion of the ceiling grid. This allows for easy manipulation of the rail 20 relative to the metal portion of the ceiling grid allowing the rail to be easily adjusted relative to the ceiling grid to allow proper alignment of the rail 20 with the metal portion of the ceiling grid.

In one embodiment, during alignment, the attraction between the magnetic strip 30 and the metal portion of the ceiling grid is insufficient to overcome the bias of the rail 20 towards a bowed configuration. However, once the rail 20 is aligned with the metal portion of the ceiling grid, the middle portion 34 may be displaced towards the metal portion of the ceiling grid. As the middle portion 34 is displaced towards the metal portion, the magnetic attraction between the portion of the magnetic strip 30 between the end portions 32 and 36 and the metal portion of the ceiling grid becomes sufficient in force to overcome the bias of the rail 20 towards the bowed configuration. At this point, the rail 20 transitions from the uncoupled, bowed configuration to the unbowed, coupled configuration, and the entire length of the base 28 from the first end portion 32 to the middle portion 34 to the second end portion 36 are brought generally into alignment in the same generally horizontal plane, with the entire length of the magnetic strip 30 in contact with the metal portion of the ceiling grid. When more of the magnetic strip 30 than the end portions 32 and 36 is in contact with the metal portion of the ceiling grid, the attractive force between the magnetic strip and the metal portion of the ceiling grid is strong (relative to when only the end portions 32 and 36 are in contact with the metal portion of the ceiling grid), and, therefore, it is more difficult to adjust the alignment of the rail 20 relative to the metal portion of the ceiling grid.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of displaying signage comprising:

providing a rail including a base having a magnetic strip having a continuous and uninterrupted curved mounting surface, and a support coupled to the base, the rail having a curved longitudinal shape;

adjusting the rail relative to a fixture to which the rail is to be coupled such that first and second end portions of the magnetic strip contact the fixture without a middle portion of the magnetic strip interposed between the first and second end portions contacting the fixture; and coupling the rail to the fixture such that the middle portion contacts the fixture.

2. The method of claim 1, wherein the rail includes a support defining a channel configured to support signage, further comprising placing signage within the channel defined by the support.

3. The method of claim 1, wherein the fixture is a metal portion of a ceiling grid.

4. The method of claim 1, wherein the middle portion is offset from the first end portion and the second end portion relative to a horizontal reference plane.

5. The method of claim 4, wherein the middle portion is offset from the first end portion and the second end portion in a direction perpendicular to the horizontal reference plane when the rail is in the first configuration by at least 1/16th of an inch.

6. The method of claim 1, wherein the first end portion, the middle portion, and the second end portion are in a single reference plane when the rail is coupled to a fixture.

* * * * *